US005188132A

United States Patent [19]

Barkus

[11] Patent Number: 5,188,132

[45] Date of Patent: Feb. 23, 1993

[54] COMB FOR APPLYING HAIR COLORING DYE

[76] Inventor: Philip Barkus, 407 Cartwright Blvd., Massapequa Park, N.Y. 11762

[21] Appl. No.: 912,481

[22] Filed: Jul. 13, 1992

[51] Int. Cl.[5] ..... A45D 24/00

[52] U.S. Cl. ..... 132/219; 132/116; 132/150

[58] Field of Search ..... 132/109, 116, 125, 143, 132/150, 155, 213.1, 214, 219, 112, 113, 114

[56] References Cited

U.S. PATENT DOCUMENTS

| | | | |
|---|---|---|---|
| 302,734 | 7/1884 | Jobson | 132/150 |
| 1,440,069 | 12/1922 | English | 132/150 |
| 1,708,419 | 4/1929 | Jurich | 132/143 |
| 2,005,520 | 6/1935 | Friedmann | 132/155 |
| 2,112,561 | 3/1938 | Duckworth | 132/150 |
| 2,128,183 | 8/1938 | Hickey | 132/116 |
| 2,151,056 | 3/1939 | Stone | 132/150 |
| 2,177,907 | 10/1939 | Morris | 132/155 |
| 2,436,548 | 2/1948 | Booth | 132/109 |
| 2,761,459 | 9/1956 | Kaul | 132/109 |
| 3,059,652 | 10/1962 | Thomas | 132/112 |
| 3,277,902 | 10/1966 | Korst | 132/150 |
| 3,572,351 | 3/1971 | Perry | 132/213.1 |
| 3,683,942 | 8/1972 | McKay | 132/112 |
| 3,916,918 | 11/1975 | Spinks | 132/150 |
| 5,067,502 | 11/1991 | D'Orsi et al. | 132/213.1 |
| 5,131,418 | 7/1992 | Vaccaro | 132/213.1 |

*Primary Examiner*—Gene Mancene
*Assistant Examiner*—Frank A. LaViola

[57] ABSTRACT

A comb having spacers between adjacent resilient plastic teeth strategically located adjacent the lower ends thereof which creates above and below these spacers clearance spaces between adjacent teeth, the spaces above being for storage of hair coloring dye, and the spaces below to enable strands of hair to enter between and cam apart the flexible teeth.

1 Claim, 2 Drawing Sheets

COMB FOR APPLYING HAIR COLORING DYE

The present invention relates generally to improvements in hair grooming, and specifically in applying hair coloring dye, the improvements more particularly residing in a comb for this purpose.

EXAMPLES OF THE PRIOR ART

Combs for special purposes are, of course, already well known, as exemplified by the comb of U.S. Pat. No. 2,216,355 issued to Pollock on Oct. 1, 1940 to rid the hair of resulting haircut-produced small ends of hair, or by the comb of U.S. Pat. No. 3,916,918 issued to Spinks on Nov. 4, 1975 designed especially for use by handicapped persons, to mention but a few.

There are no known prior art combs that facilitate the application of hair coloring dye. The viscosity of commercially available hair coloring dye or lotion inhibits "combing" the dye into the user's hair with existing combs, and it must therefore often be done using a brush, which afterwards must be cleaned with some difficulty, is not a convenient implement from a neatness' point of view, and suffers from other disadvantages.

Broadly, it is an object of the present invention to provide as an implement to apply hair coloring dye a comb in the traditional sense, with the important exception that it is particularly adapted for the purpose intended, and overcomes the foregoing and other shortcomings of the prior art during hair coloring dye application. More particularly, it is an object to provide a hair color-applying comb that maintains the spacing between adjacent teeth despite the tendency of the viscosity of the dye to close this spacing, and otherwise has noteworthy attributes as hereinafter will be subsequently described in greater detail.

The description of the invention which follows, together with the accompanying drawings, should not be construed as limiting the invention to the example shown and described, because those skilled in the art to which this invention appertains will be able to devise other forms thereof within the ambit of the appended claims.

Figure 4:
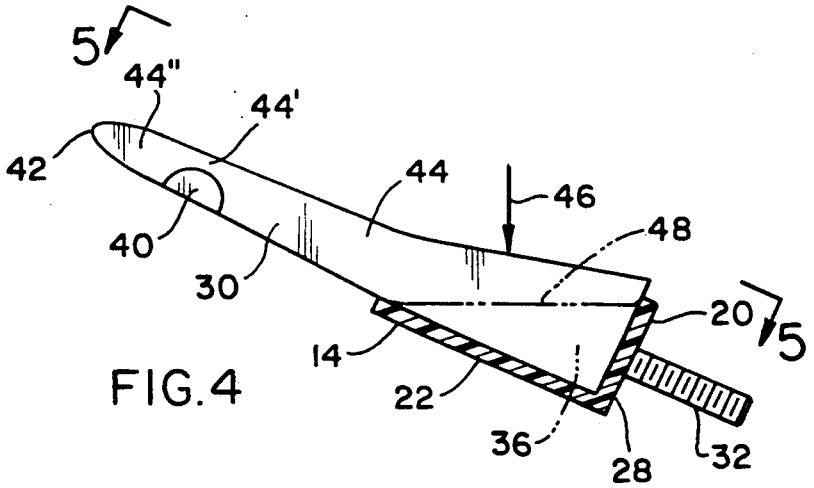
FIG. 4 is a cross sectional view of the comb as taken along line 4—4 of FIG. 3, drawn to a somewhat enlarged scale, illustrating internal structural features thereof.
Figure 5A:
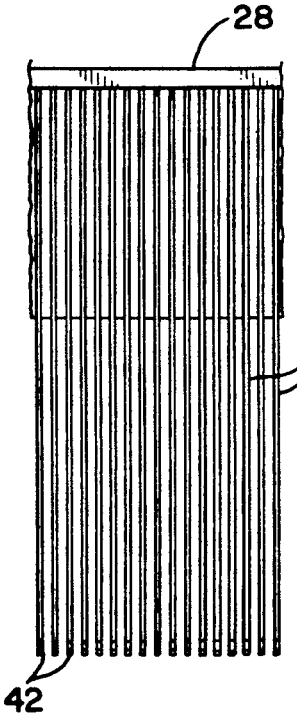
Figure 5B:
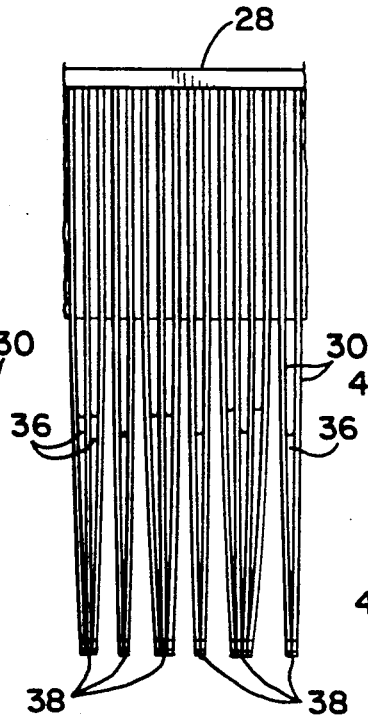
Figure 5C:
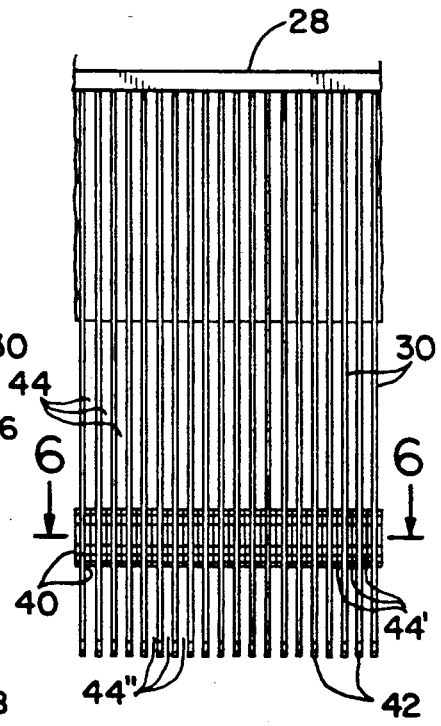
Figure 6:
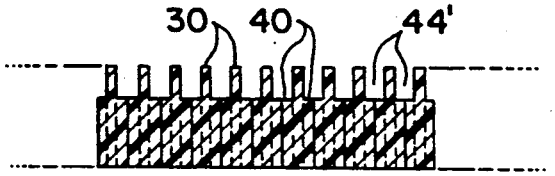

FIGS. 5, 5A, 5B and 5C are schematic plan views as taken along line 5—5 of FIG. 4 intended to be instructional figures illustrating in FIGS. 5A and 5B a possible shortcoming in the use of a comb for applying hair coloring dye, and wherein FIG. 5C illustrates how this shortcoming is obviated in accordance with the present invention; and FIG. 6 is an enlarged scale cross sectional view, as taken along line 6—6 of FIG. 5C illustrating in greater detail noteworthy structural features of the within inventive comb.

Figure 1:
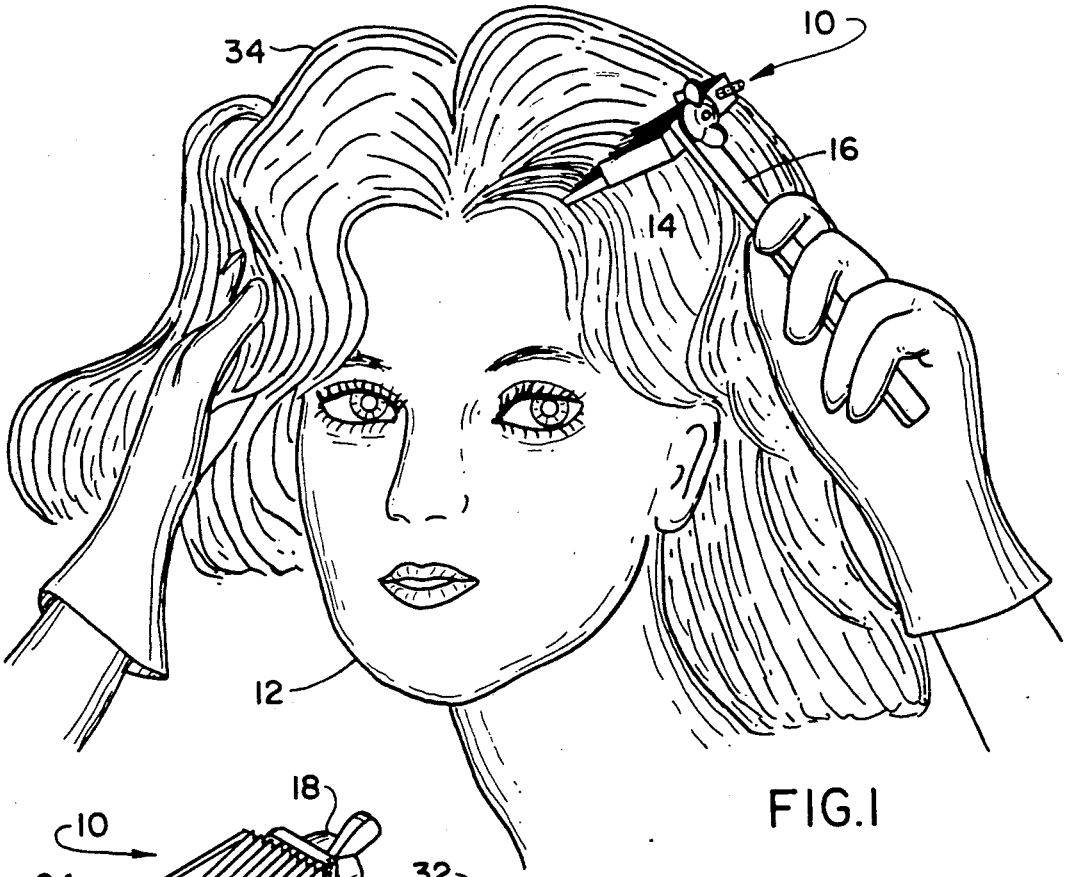
FIG. 1 is a perspective view of the within inventive comb during an intended end use of applying hair coloring dye.

Shown in FIG. 1 is the within inventive comb, generally designated 10, in a typical contemplated end use of applying hair coloring lotion or dye to the hair of a user 12, illustrated as a female, but understood to also have usefulness for a male desirous of darkening grey hair, or the like.

Figure 2:
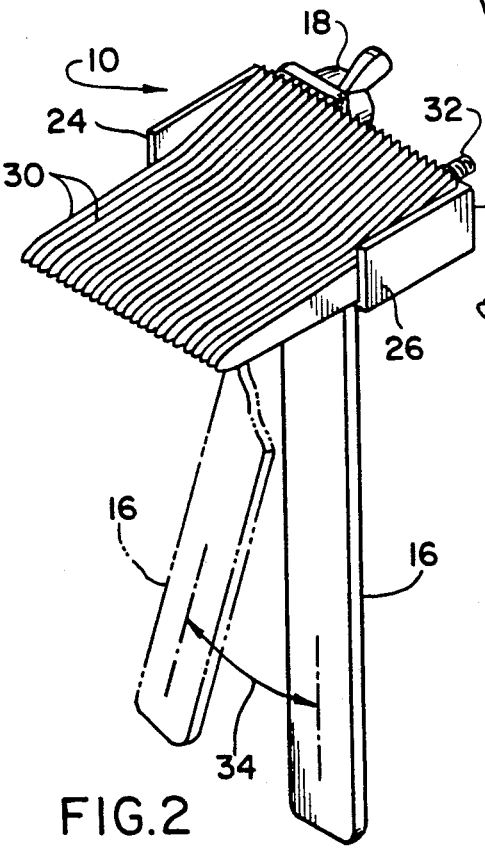
FIG. 2 is a perspective view of the comb in which positions of movement of the handle are illustrated in phantom and full line perspective.
Figure 3:
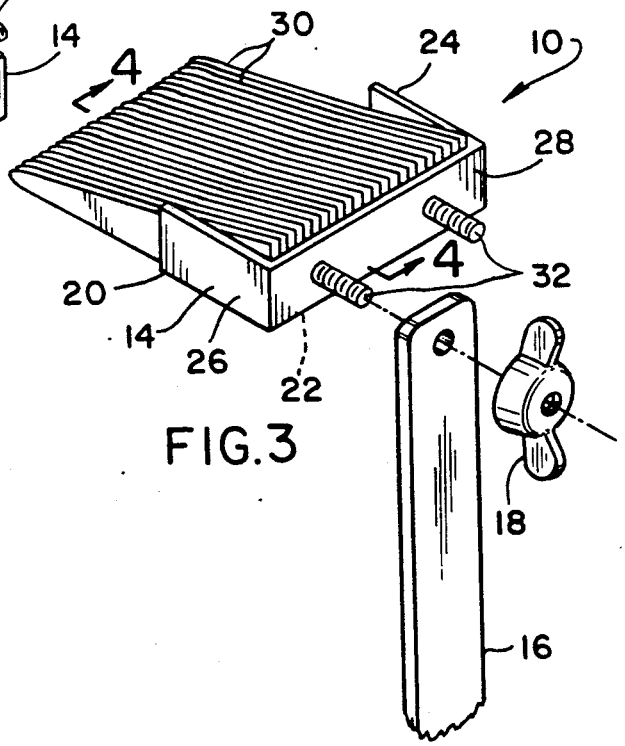
FIG. 3 is another perspective view of the comb with the handle disassembled therefrom.

In a preferred embodiment, comb 10 is comprised of a comb body section or U-shaped bracket 14 to which a handle 16 is adapted to be attached to either one of two externally threaded bolts 32 by a wing nut 18. Bracket 14 is comprised of a box-like structure 20 having a bottom wall 22 and left and right side walls respectively designated 24 and 26, and a rear wall 28, all of which cooperate to form a housing for one end of an array of comb teeth, individually and collectively designated 30. As best understood from the perspective view of FIG. 3, the studs 32 which extend from the rear wall 28 allow selective attachment of the handle 16. The user 12 accordingly may attach handle 16 to the bracket 14, depending upon the stud 32 that is selected, at any convenient angle 34 (see FIG. 2) that is most suitable for passing the comb teeth 30 through the hair of the user. Additional adjustments in angle 34 are, of course, easily made by loosening and then tightening the wing nut 18 as required during the application of the hair coloring dye.

The patentable advance over known prior art combs for applying hair coloring dye or lotion resides in the shape and function of the comb teeth 30, now to be described in detail. Preliminarily, however, it is to be noted that instructions in the current do-it-yourself and hair color application kits call for the user to apply the hair coloring lotion or dye directly from a dispenser bottle. It has been found that frequently following this instruction results in uneven distribution of the lotion or dye in the spaces between adjacent teeth, and that this in turn causes varied degrees of hair coloring, which is undesirable. The within inventive comb 10 allows the user to achieve a complete and even distribution of coloring lotion or dye throughout his or her hair 34 and with a minimum contact of the lotion or dye 36 with the user's scalp, the latter being a desirable condition since hair coloring dye or lotion is often toxic and can produce an allergic reaction in contact with the user's skin or scalp.

In accordance with the present invention, therefore, teeth 30 are optimumly in cross section thin and flexible and the spacing between adjacent teeth is selected to be nominal so as to accommodate in this space a minimum number of strands of hair 34. In a preferred embodiment, bracket 14 houses approximately thirty-six teeth 30 each having a thickness of 0.020 inches and a center-to-center spacing of 0.052 inches. The length and width of each tooth 30 is selected to bound what can aptly be characterized as an open compartment for a reasonable amount of hair coloring lotion 36. The referred-to dimensions of the teeth 30 can be varied to suit the fineness of the strands of hair 34 and also the specific viscosity of the lotion 36.

As may best be understood from the schematic representation of comb 10 shown in FIG. 5A there is a possible shortcoming that might result in the use of such a comb, this shortcoming being shown in FIG. 5B and now to be described, it being understood that an actual illustration of the within inventive comb is shown in FIG. 5C, from which by comparison it can be better understood that the FIG. 5C comb is an effective solution in obviating the shortcoming of FIG. 5B. More particularly, as best illustrated in FIG. 5B, when comb 10 of FIG. 5A is wetted with solution 36, the gravity flow of this lotion down the length of the teeth 30, as affected by surface tension and capillary action during this gravity flow, cause adjacent teeth 30 to close upon each other in random groups 38 of 2, 3 or 4 teeth, as shown in FIG. 5B. This is particularly so, since as already noted, the plastic construction material of the individual teeth 30 and their nominal thickness render these teeth very flexible and with little or no ability to resist forming into the referred-to groupings 38. As a result, the desirable benefits of making the teeth 30 thin and closely spaced is neutralized.

Underlying the present invention is recognizing the problem above described, and in obviating the teeth 30 forming into the groups 38. More particularly, the solution, according to the present invention, is providing a pair of spacers 40 as an integral part of each tooth 30 at a spaced distance slightly upwardly from the free ends 42 of the teeth 30. As shown in FIG. 5C, the two outboard teeth 30 have spacers 40 only on their inboard surfaces, while the other teeth 30 have a spacer 40 on each opposite side thereof. Spacers 40 are of a selected thickness that is approximately one half the spacing 44 between adjacent teeth 30. It is important to note that functionally the spacers 40 preserve the spacing 44" of the ends 42 of the teeth 30, as well as the parallel position of the tooth ends 42, the significance of which will now be explained.

When the user 12 has gone through the preparatory steps of applying the hair coloring dye or lotion in the spacing between the teeth 30 and in the length portion thereof about which the bracket 14 is disposed in encircling relation, so that the wall 22 of bracket 14 minimizes leakage of the lotion, the user is ready to apply the lotion 36 to her strands of hair 34. Preliminarily, however, she (or he) will first adjust handle 16 to a desired angular position. The body section or bracket 14 is accordingly appropriately oriented so that structure 20 is located approximately as shown in FIG. 4, and the user 12 then dispenses into the comb lotion 36 as denoted by the arrow 46 until there is a supply denoted by the transverse line 48. That is, enough lotion 36 should be dispensed to reach a level denoted by line 48 in the spaces 44 between adjacent teeth. Structure 20 thus effectively serves as a reservoir for lotion 36 until comb 10 is tilted or angularly oriented to the position shown in FIG. 1. As a consequence of this position change, gravity and capillary action will urge lotion 36 in gravity movement along each space 44 and the flowing lotion will, in effect, overflow over the encountered spacers 40 and fill each space 44' (see FIG. 6) and eventually move into spaces 44" near the tooth ends 42. At this point in use, the user 12 will move comb 10 into contact with her head of hair 34 with the result that the strands of hair 34 will enter into the spaces 44' which have been maintained accessible for this purpose by the spacers 40, as already described. In this regard, it has been noted that in practice the strands of hair 34 can accurately be characterized as wedging themselves in the spaces 44" and camming apart adjacent pairs of teeth 30 permitting the strands of hair to wipe clean from the side of the teeth 30 the hair coloring dye or lotion that has positioned itself along the length of the comb teeth 30. This, of course, would not be possible if the teeth 30 were permitted to group together at locations 38 as noted in FIG. 5B.

It is, of course, to be understood that periodically the user will replenish the supply of lotion 36 to comb 10 and will repeat the application steps as described until all of the strands of hair 34 are suitably coated with the hair coloring dye or lotion. The periodic application is recommended to minimize the possibility of contact of the lotion 36 with the user's scalp, as might occur if an excessively large supply of lotion was positioned in the comb.

While the comb for applying hair coloring lotion or dye as herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A comb for transferring hair coloring dye to the user's hair comprising an operative arrangement of plural adjacently spaced-apart teeth for said comb of plastic construction material to provide flexing in said individual teeth in said clearances therebetween, a U-shaped bracket disposed in encircling relation about a length portion of the base of said teeth to provide a partial enclosure to prevent leakage of hair coloring dye deposited on said base of said teeth by gravity flow transversely thereof while permitting gravity flow of said deposited hair coloring dye lengthwise of said teeth, and spacer means affixed to said teeth in said clearances therebetween at a selected distance spaced from the free ends of said teeth so as to maintain said free ends of adjacent teeth in spaced relation from each other and also a selected distance spaced below the base of said teeth so as to bound therefrom extending to said spacer means of a compartment between each adjacent pair of teeth to receive therein said gravity flowing hair coloring dye, whereby the hair strands of the user are effective in initially wedging into said spaces at said teeth ends and subsequently moving upwardly along said teeth to wipe therefrom said hair coloring dye in each said compartment above said spacer means incident to causing the transfer of said hair coloring dye to said hair strands.

* * * * *